United States Patent [19]

Braude

[11] Patent Number: 4,741,450

[45] Date of Patent: May 3, 1988

[54] DRINK-THROUGH BEVERAGE LID

[76] Inventor: Elton Braude, 41-29 Fiftieth St., Suite 2E, Woodside, N.Y. 11377

[21] Appl. No.: 856,382

[22] Filed: Apr. 28, 1986

[51] Int. Cl.[4] ..... B65D 41/46; B65D 41/56

[52] U.S. Cl. ..... 220/90.4; 220/254; 220/269; 220/90.2

[58] Field of Search ..... 220/90.4, 90.2, 269, 220/254

[56] References Cited

U.S. PATENT DOCUMENTS

| | | | |
|---|---|---|---|
| 3,994,411 | 11/1976 | Elfelt et al. | 220/90.4 |
| 4,202,459 | 5/1980 | DeParales | 220/90.4 |
| 4,322,015 | 3/1982 | Bailey | 220/269 |
| 4,629,088 | 12/1986 | Durgin | 220/90.4 |

*Primary Examiner*—George T. Hall

*Attorney, Agent, or Firm*—Ostrolenk, Faber, Gerb & Soffen

[57] ABSTRACT

A lid for a drinking cup or other container wherein the lid has a restricted opening through which the contents of the container may be drunk while leaving the lid in position to prevent spillage or sloshing out of the container. The opening is covered by a flap which may be integral with the lid and separated therefrom by break lines or tear lines. The flap extends up to the edge of the cup and where a flange is provided, extending even over the flange. The flap when folded back on the hinged line opposite the rim of the lid to reveal the opening, is automatically caught against the outer surface of the lid away from the opening so that it will not interfere with drinking from the cup and so that any reason for tearing off the flap and discarding it separately from the cup is removed.

17 Claims, 3 Drawing Sheets

DRINK-THROUGH BEVERAGE LID

BACKGROUND OF THE INVENTION

The present invention relates to a lid for a drinking cup, and more particularly to a lid which is so arranged that the beverage contained in the drinking cup may be drunk without removing the lid. Lids of this general type are known and the use thereof has evolved from the necessity for drinking beverages on the run while moving rapidly from one place to another or drinking beverages in a vehicle which may not ride smoothly.

Drinking cups lids have been developed to meet this problem and more particularly many types of drinking cup lids exist wherein a portion of the lid may be pulled back or torn back along weakening lines to provide a relatively smooth drinking opening so that the sloshing of the liquid inside can be controlled even while the beverage is being drunk. The lines bounding the opening are substantially but not necessarily radial of the lid extending only a short distance from the circumference and spaced angularly from each other by a distance which would provide a comfortable drinking opening. In such prior uses of the device, little or no regard has been given to a solution of problems which may arise from the tear-away strip itself. This tear-away strip or section which forms the opening may simply be folded back apparently out of the way. But because of the resiliency of the material of which the lid is made, the tendency is for this strip to bend back toward the opening resulting in interference with the drinking. It therefore has become common for the user to tear off the tail end of this fold-back strip which in any individual case creates no substantial problem but in mass use at various vehicle depots such as bus stations and rail road stations, the pile up of these tear-away strips becomes obnoxious and creates complaints and problems. If the strip is left in place, not only is there interference with the drinking of the beverage, but also the user who does not wish to tear off the strip and throw it away will be carressed at the tip of his nose by the strip which leads to unpleasantness in the utilization of the drinking cup. Moreover, this exposed strip will invariably have a film of liquid which may smear the user.

Some of the problems that relate to the utilization of drinking cup lids are illustrated in patents such as U.S. Pat. No. 4,489,848 or in prior U.S. Pat No. 3,994,411. In the latter, some attempt was made to get the the covering strip out of the way once it was opened. This was not fully successful. To store and hold back the covering strip was a little more than could be expected from someone who was drinking his beverage on the run or in a moving and bumpy vehicle.

SUMMARY OF THE INVENTION

It should be kept in mind that the lid itself is normally made with a flange and a recessed top. The flange may be snapped over the top edge of the cup and the recessed top provides for positioning of another container above and on the lid with the other container having a frustoconic shape so that it will fit on the top inside the flange.

The tear line for the drinking opening may be made inside the flange but this can lead to difficulties, particularly in obtaining access to the edge of the flap which covers the cover. It is therefore customary to extend the flap over the flange of the cover. The container itself may be made of various materials including pressed paper, foam material or plastic. The cover itself may be made of the same or other material—more usually, a thin, resilient plastic material with the tear-line built in so that the flap may be torn back.

In practicing the invention, the tear-open flap which initially covers the drinking opening in the cover is so arranged that when it is opened it is held back in the opened position. The means for holding the tear-open flap in the open position is one which will occur automatically on the full opening of the tear-open flap and not require special manipulation of any kind on the part of the user. Thus, a simplified means for holding the tear-open flap for the opening in place may constitute resilient elements into which or past which the cover may snap in order to hold it in place or other elements including an adhesive spot which will hold the cover appropriately. The snap elements may comprise ridges with recesses built into the cover and past which the cover may snap or studs or buttons with similar recesses or an appropriate cross-cut opening in the cover which is essentially closed and which may snap past a bump or pin-like or post-like extension from the cover, or even an adhesive at the cover which may cooperate with the tear-open flap and be so arranged that it will not adhere to anything but a similar adhesive which would be placed on an appropriate location and distance from the hinged edge of the tear-open flap to engage the particular section.

The essential element is that the tear-open flap be held in place when it is folded back and be automatically engaged for that purpose without any manipulation being required on the part of the user.

The foregoing and many other objects of the present invention will become apparent in the following description and the accompanying drawings.

It should be noted that the upstanding elements which retain the flap may be sufficiently closely spaced to grasp the flap frictionally or may be provided with slots adjacent the upper surface of the cover or the flap to snap into place. In either case, no manipulation is required.

DETAILED DESCRIPTION OF THE PREFERRED EMBODIMENTS

Referring first to FIGS. 1, 2, 3, 4 and 5, the novel covering flap for an opening through which the drink may be taken by the user is so arranged that it will upon opening and without manipulation be held back away from the opening and away from the user without the need for the user to manipulate the flap or hold it out of his way or to tear if off to prevent interference by the flap. The essential element is that the flap remains with the lid after it has been pulled away so that the problem of possible environmental pollution, drain blockage or the entry of discarded flaps into delicate machinery is eliminated.

The basic and novel advance of the present invention requires that the flap be folded so that the inside part which has been exposed to the liquid and which would therefore carry a film of the liquid will not come into contact with the user while drinking.

Another essential element is that the securement of the open flap to the lid itself and away from the opening may be provided in a number of similar but effective ways. This is achieved by the utilization of holding nipples or holding rails which may be sufficiently closely spaced to grasp the flap frictionally. The rails or nipples may have small horizontal ridges at their summits or notches at their bases into which the edges of the flap will snap without necessarily being manually manipulated thereinto. In addition, the hold back may be an adhesive spot on the cover to be engaged by the flap or by a folded-up section of the flap. In addition, the flap in the cover may have corresponding elements such as a cross slit opening on the flap and a bump on the cover which will engage the cross slit opening.

Figure 1:
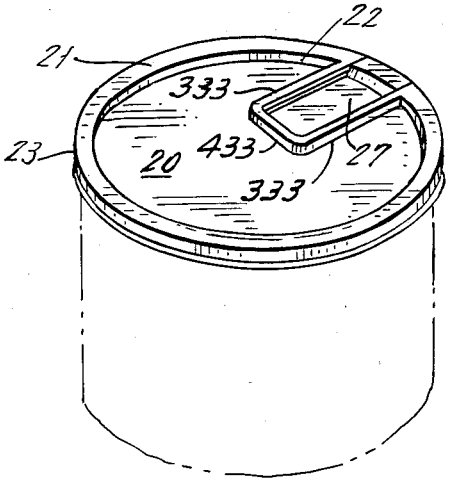
FIG. 1 is a view in perspective of a preferred form of the invention.
Figure 2:
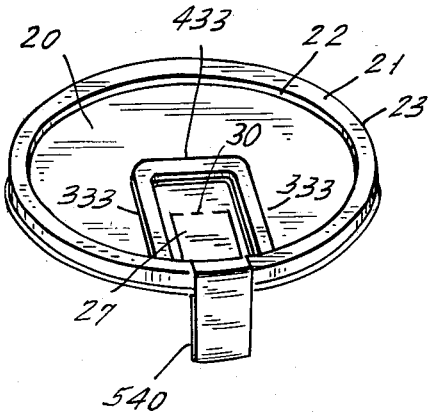
FIG. 2 is a view in perspective of the novel cover showing a flap which covers the opening with an additional tab hanging therefrom.

In FIG. 2, there is shown a preferred form of a closing flap for a lid opening where the flap 27 is provided with an additional tab 540 which may readily be grasped to open the flap 27 to reveal the opening 25. In the usual case, such a flap 27 would extend down over the wall 22 at the flange of the lid and the top wall 21 and the parallel wall 23 and provide some means for grasping the end of the tab by providing the overhang 540. The grasping operation is greatly facilitated and the tab may more readily be removed. This is also true of the arrangement hereinafter described wherein the flap 27 may also be provided with an overhang tab 640 to facilitate removal. Such a tab when lifted and folded back from the position of FIG. 2 is folded into the position shown in FIG. 4 and then pressed down into the position shown in either FIGS. 6 or 1 making the hanging tab 640 such that it may readily be held in position.

Figure 5:
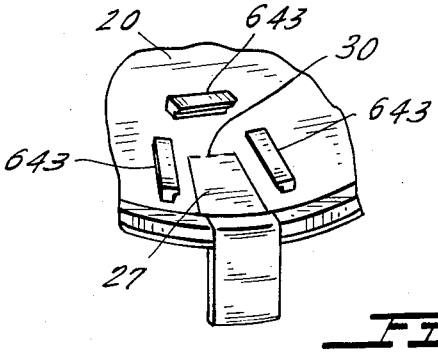
FIG. 5 is a top plan view of elements which may be utilized to hold the tab in place when it is folded back.

In FIG. 5, there is shown a construction somewhat similar to that of FIG. 1 where a plurality of rails 643 are shown spaced from each other but spaced closely enough so that the flap 27 will be frictionally caught between them and retained. Where slits or openings are provided at the base of the rail 643, the edges of the flap 27 will snap into them as they are pushed down toward the top surface of the lid.

Figure 6:
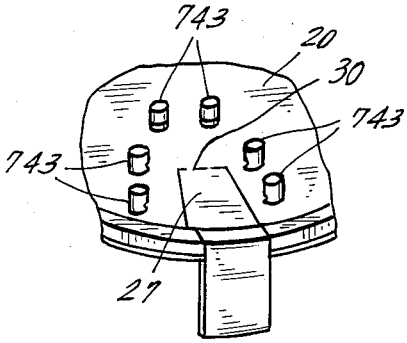
FIG. 6 is a top plan view showing additional elements for holding the tab in place when it is folded back and holding also the rear end.

In FIG. 6, there is shown a further arrangement wherein a plurality of the nipples 743 is shown arranged to engage the edges of the tabs frictionally. Where the bases of the nipples 743 are slotted or slit, the sides of the flap 27 when pushed down will snap into the slits.

Figure 7:
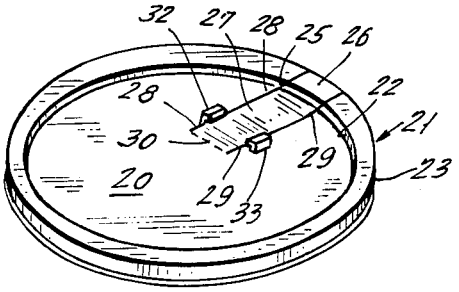
FIG. 7 is a top view in perspective of a preferred aspect which the novel cover of the present invention may take showing detented hold backs for the strip which opens the drinking orifice on the cover.

In FIG. 7 there is shown a lid 20 having a recessed edge member 21 having an inner upstanding wall 22 and an outer parallel wall 23. The walls 21, 22, 23 may form a compound flange which may snap over the top of a cup or other container. The lid is provided with an opening 25 which extends at 26, preferably into and over the flange 21, 22, 23 and a flap 27 which covers the opening. The flap is defined by the tear lines 28 and 29. It should be noted that since it is intended that the beverage be drunk immediately, the opening 25 may be covered by the flap 27 without necessarily insuring that there is a bond at the lines 28, 29. It may also be possible to have tear or parting lines at the sides 28, 29 so that the flap 27 when it is lifted up will simply separate from the rest of the cover revealing the opening 25. When the flap 27 is thus lifted up, it is folded back on the fold line 30 to the position shown in FIG. 4. There the sides 28, 29 may snap between the upstanding nipples 32, 33 which may be close enough to frictionally engage the sides of the flap 27 and hold it in place To further ensure that the engagement will not be interrupted or disrupted, the summits of the nipples 32, 33 may have horizontal ridges, the bases of the nipples 32, 33 may be slit or slotted so that as the flap 27 is pressed down between the nipples 32, 33, they will snap into the opposing slots without being necessarily guided thereinto.

Figure 3:
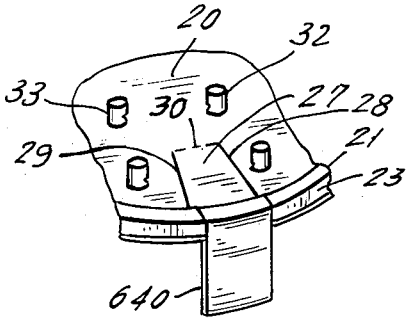
FIG. 3 is a view corresponding to the cover flap of the invention with the tab in place.
Figure 4:
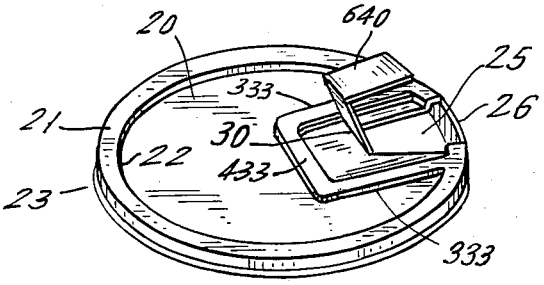
FIG. 4 is a view in perspective of the cover showing the method of folding the flap to have it retained by the retaining members on the top of the cover.
Figure 8:
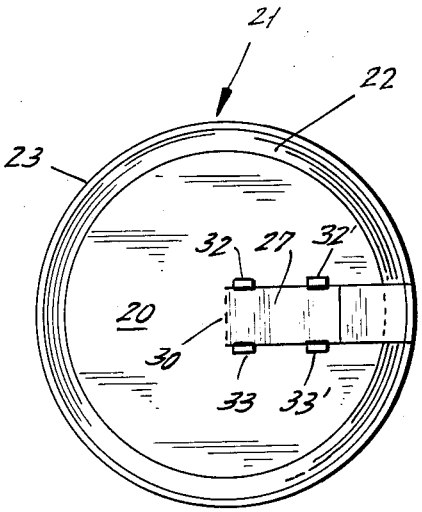
FIG. 8 is a top plan view corresponding to the cover of FIG. 7 showing two pairs of detent elements.
Figure 9:
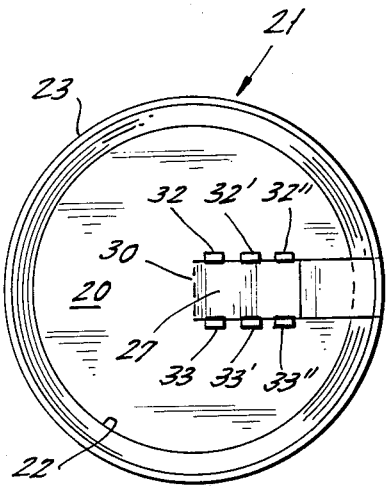
FIG. 9 is a top plan view corresponding to the views of FIGS. 7 and 4 showing the utilization of three pairs of detent elements as hereinafter described.

Referring to FIGS. 7, 8 and 9, in order to hold the flap 27 in place in the opened position, an additional set of nipples 32', 33' may be provided. These are, in most cases, not essential for holding the flap in place but where the flap material is very thin or the cover material is very thin, they will provide additional means for holding the flap in place. The structures 32', 33' are for all purposes identical to the structures 32 and 33. Also, as seen in FIG. 3, an additional set of such nipples 32" and 33" provide three elements of engagement on each side. These would be useful again where the material of the cover which may be a plastic cover is very thin and therefore the flap may be more flexible than is usually expected and such a flap would then be held more firmly in place out of the way by the utilization of three nipples. The essential purpose, of course, as previously described, is holding the flap out of the way for the reasons described above.

Figure 11:
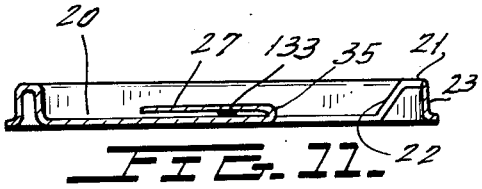
FIG. 11 is a view corresponding to FIG. 4 taken on line 5—5 of FIG. 4 showing the tear-open flap held back.
Figure 12:
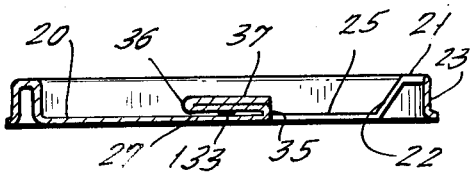
FIG. 12 is a cross-sectional view corresponding to that of FIG. 11 showing the tear-open flap folded and held back by the same adhesive spot.
Figure 10:
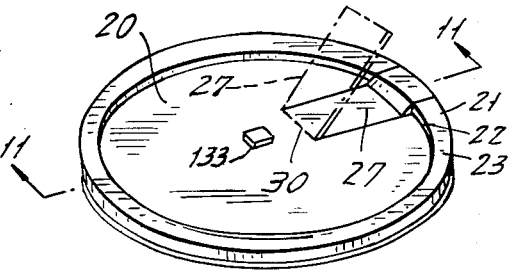
FIG. 10 is a view partially in perspective of a modified form of the cover element of FIGS. 1, 2 and 3 showing the utilization of an adhesive spot to hold back the tear-off cover for the drinking opening.

As a modified form of the structure shown in FIGS. 1, 2 and 3, there is shown in FIG. 10 the utilization of an adhesive spot 133 on the lid 20 for holding the flap 27 in place. As shown in FIGS. 10 and 11, when the cover flap is opened up, it is bent back and simply pressed down on the adhesive spot 133. The adhesive spot may be of such material that it will adhere only to the surface of the flap 27 or the top of the flap 27 may be provided with a complementary adhesive spot. As shown in FIG. 5, the bending back of the flap 27 engages its outer surface with the adhesive spot 133. As seen in FIG. 12, the flap may be provided with an additional fold line 36 in addition to the fold line 35 so that a rearward portion of the flap may be interengaged with the adhesive spot 133. Section 37 of the flap 27 may in that case stand up around a fold line 36 but would be remote from the opening 25 from which the drink is taken or the inner surface of the flap 27–37 of the structure of FIG. 10 may be coated with material which is adhesive to itself when it is folded back to the position shown in FIG. 10. In the latter case, while such material would be on the inside of the lid, the contact with the liquid would only be momentary until the flap 27 is folded back to permit drinking to occur.

Figure 13:
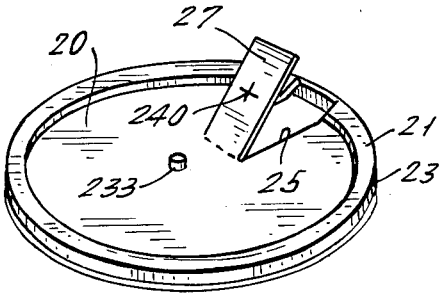
FIG. 13 is a view in perspective of a modified form of the cover element having another method of holding back the flap of the opening to keep it out of the way.
Figure 14:
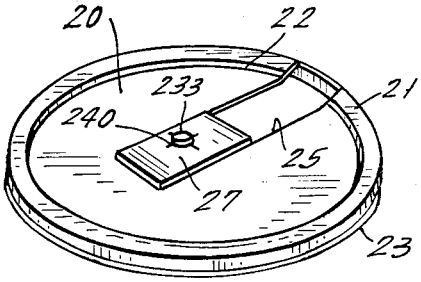
FIG. 14 is a view corresponding to that of FIG. 13 showing the flap held back.

In FIGS. 13 and 14, there is shown a modified form in which the lid is provided with a simple upstanding projection 233 and the flap 27 is provided with a cross slit 240 which will snap over the projection 233 and be engaged thereby.

Figure 15:
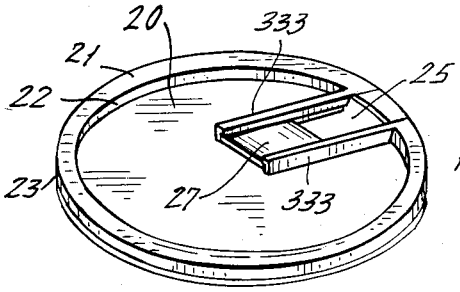
FIG. 15 is a view in perspective corresponding to FIGS. 1 and 4 showing the tab being held open by a pair of upstanding rails formed to have an inherent detent or spaced closely enough to engage the flap.

In FIGS. 1, 6 and 9, there is shown a modified form of the holding structure of FIGS. 7, 8 and 9 where, instead of spaced nipples, a pair of rails 333, 333 are provided in FIG. 15 between which the flap 27 may be pushed. The rails will have horizontal ridges that will hold the tab in place after it has been slotted in. However, the rails are close enough together, the frictional holding of the sides of the flap 27 are sufficient to hold it in place but the the bases of the rails may be provided with appropriate slits or recesses into which the sides of the flap 27 will snap. Note that in this case, the sides of the flap need not be guided into such a slit at the base at the rails 333, since the merely pressing it down between the rails 333 will snap it into any space or recess at the base of the rails 333.

It should also be noted that the material of the lid is sufficiently flexible that it may readily be pulled off the mold even where ridges are provided on the rails.

In FIG. 1, a modified form is shown in which the rails 333, 333 are used but an additional rail 433 is used to engage the outer end of the flap. Note again that where a slit or space is provided at the base of the rails, the flaps will be guided thereinto automatically by merely pressing the flap down between the rails and will not require guidance into said rails. The rails with horizontal ridges will hold the tab in place after it has been slotted in.

In all of the foregoing lids, the essential and common element is the arrangement of the lid with an opening for drinking covered by a flap usually integral with the lid separated from the lid by break lines or tear lines and hinged to the lid at its rear end away from the opening. The flap is, in all cases, held back out of the way so that the user will not be tempted to tear it off to diminish the ecological purity of the area. The flap is so held out of the way of the user by means which require no manipulation on the part of the user other than pulling open the flap and pressing it down against the top of the lid from which it is hinged.

The various holding elements which constitute the horizontal ridges with the nipples or the rails or the holding element of FIG. 13 may all be made integral with the lid since the lid is customarily a plastic lid which is formed by appropriate dies or molds as the case may be and wherein the various holding elements, such as holding element 233 of FIG. 13 the nipples 32, 33 of FIG. 1 the rails 333 of FIGS. 9 and 10 and the horizontal ridges of the nipples or rails may all be formed during hte formation of the lid by appropriate confirmation of either the die or mold so that the operation forming these folding elements and shaping them accordingly is automatically performed with the only additional cost required being the initial confirmation of the die or mold to the appropriate shape. Since the lids are made in tremendous quantities, any specific hand operations in the manufacture of the lid must, for virtually all purposes, be obviated and hence the kind of holding element which is utilized on the lid is one which will permit release of the lid from the die or mold once the lid is formed. This becomes possible because the material of the lid is inherently elastic, resilient and flexible.

Air may be inducted in the mold to the nipple or rail summit to produce horizontal ridges, or an inflatable counter mold may be used for this purpose, or the molded lid may be blown off by air passing through ducts in the mold.

The horizontal rails may be used to hold down the tab, or the slits may be added at the bases of the ridges to produce a flatter hold down.

In the forgeoing, the present invention has been described in connection with preferred illustrative embodiments thereof. Since many variations and modifications of the present invention will now be obvious to those skilled in the art, it is preferred that the scope of this invention be determined not by the specific disclosure herein made, but only by the appended claims.

What is claimed is:

1. A lid for a drinking cup, said lid having an opening adjacent the edge of the lid and the rim of the cup on which it is to be mounted;

a flap covering said opening, said flap having a closed position and an open position, and having an interior face which in said closed position faces the interior of the cup on which said lid is mounted, and an exterior face which in said closed position faces away from the interior of the cup;

said flap being hinged at a first hinge line spaced inwardly of the lid by a distance of the order of the length of the flap, said flap being rotatable on said first hinge line upwardly and away from said opening in said open position of said flap;

said flap having a second hinge line away from aid first hinge line and toward said edge of said lid, said flap being rotatable into said open position on said second hinge line, in a direction of rotation opposite to that of said first hinge line, simultaneously with rotation on said first hinge line:

said interior face thereby remaining substantially concealed from the exterior of the cup while uncovering a portion of said opening adjacent the rim of the cup, when said flap is in said open position; and holding means on the lid for retaining said flap in said open position to restrain it from rotating and thereby covering said opening; said holding means comprising holding members extending upwardly from the exterior face of said lid, said holding members extending in spaced relation to each other at distances which cause them to closely engage edges of the flap when the flap is rotated into said open position.

2. A lid for a drinking cup, said lid having an opening adjacent the edge of the lid and the rim of the cup on which it is to be mounted;

a flap covering said opening, said flap having a closed position and an open position, and having an interior face which in said closed position faces the interior of the cup on which said lid is mounted, and an exterior face which in said closed position faces away from the interior of the cup;

said flap being hinged at a first hinge line spaced inwardly of the lid by a distance of the order of the length of the flap, said flap being rotatable on said first hinge line upwardly and away from said opening in said open position of said flap with at least a portion of said flap in substantially surface to surface engagement with the lid;

said flap having a second hinge line away from said first hinge line and toward said edge of said lid, said flap being rotatable into said open position on said second hinge line, in a direction of rotation opposite to that of said first hinge line, simultaneously with rotation on said first hinge line;

said interior face thereby remaining substantially concealed from the exterior of the cup while uncovering a portion of said opening adjacent the rim of the cup, when said flap is in said open position; and holding means on the lid for retaining said flap in said open position to restrain it from rotating and thereby covering said opening; said holding means comprising an adhesive spot on said exterior face of said lid located to engage said portion of the flap which is rotated into surface to surface engagement with said lid in said open position.

3. The lid of claim 2 and having also a complementary adhesive element on the exterior face of said flap to engage said adhesive spot.

4. The lid of claim 1, wherein said holding members are spaced with respect to each other so that opposite holding members are engaged frictionally against the flap.

5. The lid of claim 1, wherein horizontal ridges are provided in an upper area of said holding members to ensure retention of the flap.

6. The lid of claim 4, wherein said holding members comprise a pair of nipple elements extending from the exterior face of said lid and spaced to frictionally engage said flap.

7. The lid of claim 6, wherein the bases of said nipple elements are provided with slits to receive opposite edges of said flap.

8. The lid of claim 6, wherein a plurality of additional pairs of holding members are provided opposite each other to engage the sides of said flap.

9. The lid of claim 8, wherein an additional holding member engages the end of said flap.

10. The lid of claim 1, wherein said holding members comprise a pair of rails with horizontal ridges at upper ends thereof arranged opposite each other to engage said flap.

11. The lid of claim 10, wherein an additional holding member is provided to engage the end of said flap.

12. The lid of claim 10, wherein the bases of said holding members provide space into which the edges of a flap may snap.

13. A lid for a drinking cup, said lid having an opening adjacent the edge of the lid and the rim of the cup on which it is to be mounted;

a flap covering said opening, said flap having a closed position and an open position, and having an interior face which in said closed position faces the interior of the cup on which said lid is mounted, and an exterior face which in said closed position faces away from the interior of the cup;

said flap being hinged at a first hinge line spaced inwardly of the lid by a distance of the order of the length of the flap, said flap being rotatable on said first hinge line upwardly and away from said opening in said open position of said flap and at least partially into substantially surface to surface engagement with the lid;

said flap having a second hinge line away from said first hinge line and toward said edge of said lid, said flap being rotatable into said open position on said second hinge line, in a direction of rotation opposite to that of said first hinge line, simultaneously with rotation on said first hinge line;

said interior face thereby remaining substantially concealed from the exterior of the cup while uncovering a portion of said opening adjacent the rim of the cup, when said flap is in said open position; and holding means on the lid for retaining said flap in said open position to restrain it from rotating and thereby covering said opening; said holding means comprising holding members, said holding members comprising a retaining element on the top of the lid and a slit-type opening adjacent a portion of the flap near said edge of said lid to engage said retaining element when the flap is in said open position;

wherein the flap is hinged transversely at a line inwardly of said edge of said lid to provide an additional fold line for the flap.

14. The lid of claim 1, wherein an extension tab is provided at a portion of said flap away from said hinges, and beyond the edge of said lid in said closed position, in order to provide a holder for manipulating said flap.

15. The lid of claim 13, wherein the flap is hinged transversely at a line inwardly of said flange to provide an additional fold line for the flap.

16. The lid of claim 10, wherein said rails have projecting ridges at upper areas thereof directed toward the opposite rails.

17. The lid of claim 10, wherein slits are located adjacent lower ends of said rails to receive the flap.

* * * * *